US010000315B2

(12) United States Patent
Faris

(10) Patent No.: US 10,000,315 B2
(45) Date of Patent: Jun. 19, 2018

(54) COLLAPSIBLE COOLER LINER

(71) Applicant: Travis Faris, Independence, KY (US)

(72) Inventor: Travis Faris, Independence, KY (US)

( * ) Notice: Subject to any disclaimer, the term of this patent is extended or adjusted under 35 U.S.C. 154(b) by 0 days. days.

(21) Appl. No.: 14/929,137

(22) Filed: Oct. 30, 2015

(65) Prior Publication Data

US 2017/0121059 A1 May 4, 2017

(51) Int. Cl.

| | |
|---|---|
| ***A47J 39/00*** | (2006.01) |
| ***B65D 25/16*** | (2006.01) |
| ***F25D 3/08*** | (2006.01) |
| ***B65D 25/32*** | (2006.01) |
| ***B65D 33/28*** | (2006.01) |
| ***B65D 33/00*** | (2006.01) |
| ***B65D 81/38*** | (2006.01) |
| *B65D 33/25* | (2006.01) |

(52) U.S. Cl.

CPC ..... *B65D 25/16* (2013.01); *B65D 25/32* (2013.01); *B65D 33/004* (2013.01); *B65D 33/28* (2013.01); *B65D 81/38* (2013.01); *F25D 3/08* (2013.01); *B65D 33/25* (2013.01); *B65D 2313/02* (2013.01); *B65D 2313/04* (2013.01)

(58) Field of Classification Search

CPC ..... B65D 25/16; B65D 81/3823; A45C 11/20; A45C 13/02; A45C 13/002

USPC ..... 220/592.2

See application file for complete search history.

(56) References Cited

U.S. PATENT DOCUMENTS

| | | | | |
|---|---|---|---|---|
| 6,151,910 | A * | 11/2000 | Hazen | B65D 81/3876 220/495.03 |
| 2002/0003098 | A1* | 1/2002 | Bell | A45C 13/02 206/373 |
| 2008/0000914 | A1* | 1/2008 | Frankenstein | A45C 13/02 220/507 |
| 2012/0279976 | A1* | 11/2012 | DeSanti | A45C 3/001 220/739 |

* cited by examiner

*Primary Examiner* — Shawn M Braden

(74) *Attorney, Agent, or Firm* — R. Christian Macke

(57) ABSTRACT

A collapsible cooler has provisions for erection and retention in a common receptacle such as a five gallon bucket, a tall kitchen garbage can and a large garbage can. Three layers of sheet material form an insulated cylindrical liner with a diameter and height corresponding to the dimensions of the common receptacle, with downwardly depending overhanging panels that extend over the upstanding walls and fold down and are secured together to hold the liner in the common receptacle. The downwardly depending overhanging panels have provisions for engaging structural elements of the common receptacle to secure the liner to and within the common receptacle. Accessory retention pockets are secured to the downwardly depending overhanging flaps and are accessible even when a lid is applied to the top of the collapsible cooler. The downwardly depending flaps have provisions for displaying indicia, logos and emblems.

12 Claims, 8 Drawing Sheets

COLLAPSIBLE COOLER LINER

FIELD OF THE INVENTION

The present invention relates generally to a collapsible cooler liner used in a common hard shell receptacle.

BACKGROUND OF THE INVENTION

The present invention generally relates to portable coolers, specifically a collapsible liner that is received in a common hard shell receptacle to function as a thermally insulated receptacle. Picnic goers, Little League baseball game attendees, party guests, concession operators, and myriad other people having the need for a cooler within which to store cold drinks and ice, have all felt the need for a common and heretofore nonexistent device, a collapsible and portable cooler that is easily transportable to the site of the picnic, game or event, which does not consume a large amount of space to transport and which can store a large quantity of drinks in a bath of ice.

Thermally insulated containers have become popular for carrying articles that are best served cool, most commonly beverages, but also things like salads and candy that are prone to melt. Portable thermally insulated containers tend to be one of two types, either a hard shelled insulated container or a soft sided insulated container. Hard shelled portable thermally insulated receptacles tend to be made of molded plastic, with an inner wall and an outer wall, and with an air insulation space between them designed to keep the contents at a temperature different from the outside air. Hard shell coolers are substantially rigid and, as a result, depending on their size, not very portable. That is, for a large event at which it is desirable to keep 80-100 drinks cold, a cooler has to be very large. In addition to the significant size dimensions and the transportation difficulty a large cooler presents, such a cooler is also very, very heavy and difficult to transport. Often, large coolers require two people to carry such a cooler from a car to the field or booth.

Soft sided coolers, on the other hand, generally comprise an inner wall and an outer wall with an insulating layer between them with all three layers made of flexible fabric. Soft sided coolers are generally collapsible and erectable by, for example, folding down side panels, making them much more transportable than hard shell coolers. However, the size of an effective softshell cooler is very limited, because the collapsible sidewalls will not be able to support nearly the number of drinks and ice as a hard shell cooler, often necessary for a large event. The prior art includes many examples of soft sided coolers, including some that are combined with hard shell liners, such that a hard shell plastic inner liner is received in a softshell outer skin. Other softshell coolers are designed to receive structural members to make them rigid. The problem with softshell coolers is that they are not rigid enough to be very big, and are generally limited to individual use.

The requirements of an effective cooler are simple. A thermally insulated receptacle capable of storing drinks and ice in it that retains water in it is desirable, so that as ice melts it doesn't leak out, and which is large enough to store the drinks, food items and ice to keep everything cold. In the past, most coolers have been constructed from a hard shell material, such as plastic or Styrofoam, and for large coolers serving a large number of people, such coolers occupy a lot of space while being transported. While there are a number of prior art devices that are soft shell collapsible type coolers, all are either size limited or require structural members to be installed or erected at the site that must be transported with the soft shell cooler. Otherwise, they remain flimsy softshell containers, the sides of which are not rigid enough to retain any significant weight of drinks and ice that is desirable to be stored such as for a large group or event. The present invention addresses this problem by providing liners to be received in common receptacles.

While liners for some common receptacles such as five gallon buckets, and large garbage cans and tall kitchen garbage cans are well known, e.g. garbage bags that are sized to fit those receptacles, and such liners are available in every grocery store in the United States, such liners and bags are not insulated, nor are they intended for reuse. Significantly, they fit into the receptacle but do not cover, disguise or camouflage the receptacle that they are retained in. When those prior art liners are placed in garbage cans, it is still very apparent that they are garbage cans. Generally, only a small extension over the top rim is provided, so the receptacle is still largely in view. In addition, the liners are thin, single ply liners that look like garbage bags and frequently tear, compromising the necessary water retaining features, so they are not very suitable as a means for turning such a receptacle into a cooler. Similarly, while liners for five gallon buckets are well known in the prior art, they are generally used so that multiple uses of the bucket are possible, for example, as a receptacle for different colors of paint, or different tools or supplies to be stored therein. None of these prior art bucket, garbage can or receptacle liners are insulated, nor are they intended to be thermal liners to maintain a temperature in the bucket, nor do they camouflage or disguise the nature of the receptacle being used, whether the five gallon bucket, garbage can or other receptacle.

In providing an innovative receptacle liner for common receptacles, it is desirable to include accessory article retention devices, for example insulated can holders and accessory holders, on a cooler, and a number of prior art hard shell coolers have included can holders, for example, in the lid of the cooler. Prior art soft shell coolers, due to the lack of rigidity and size limitations, have not generally been provided with accessory article retention devices.

The present invention provides a thermally insulated soft sided liner, large enough to accommodate a large number of drinks and ice, yet it is still very portable and collapsible. An innovative feature of the cooler liner of the present invention is that they are sized and designed to be received and retained in large, commonly available hard shell receptacles, such as a 5 gallon bucket, or a common tall kitchen garbage can, or a large garbage can. The innovative liner includes provisions for securely attaching to the common receptacle in ways that do not interfere with the handle or transport provisions of the common receptacle while still disguising and camouflaging the hard shell receptacle by providing large overhanging flaps that serve the multiple purposes of disguising the nature of the receptacle and providing a device to which accessory retention devices, i.e. can holders and the like, are secured. Providing an insulated liner that turns buckets and garbage cans into coolers, while camouflaging the fact that garbage cans and buckets are being used, eliminates the need for large, bulky and difficult to transport hard shell coolers.

OBJECTS OF THE INVENTION

It is an object of the present invention to provide a soft sided insulated liner to be received and retained in a large commonly available hard shell receptacle.

It is another object of the present invention to provide a portable cooler with a large volume that will reliably and securely retain a large quantity of drinks and ice therein.

It is yet another object of the present invention to provide a soft sided cooler liner having three layers of fabric material that is designed to fit into a common hard shell receptacle.

It is a further object of the present invention to provide a soft sided cooler liner having a pliable structure that can be erected and affixed to a common hard shell receptacle.

It is yet another object of the present invention to provide a soft sided thermally insulated cooler liner having overhanging flaps that engage the upper rim of a common hard shell receptacle.

It is another object of the present invention to provide a collapsible, thermally insulated liner having means for securing to a common hard shell receptacle that do not interfere with the handles of the receptacle.

It is yet another object of the present invention to provide a soft sided thermally insulated liner having accessory retention pockets on outer facing flaps that are available when the liner is retained in a hard shell receptacle.

It is another object of the present invention to provide a thermally insulated liner to be received in a cooperative hard shell container with cinching means for affixation to the hard shell container.

It is yet another object of the present invention to provide a soft sided thermally insulated liner having a watertight inner wall.

It is another object of the present invention to provide a soft sided thermally insulated liner having an inner wall constructed from mylar and an intermediate insulating layer constructed from flexible foam.

It is another object of the present invention to provide a thermally insulated soft sided liner having a non-absorbent outer layer to resist being stained when it is received in a common hard shell container.

It is an object of the present invention to provide a soft sided thermally insulated liner to be received in and secured to a common 5 gallon bucket that does not interfere with the use of the handle of the bucket.

It is an object of the present invention to provide a soft sided thermally insulated liner to be received in and secured to a tall kitchen garbage can that does not interfere with the use of the handle of the garbage can.

It is another object of the present invention to provide a soft sided thermally insulated liner to be received in and secured to a large garbage can that does not interfere with the use of the handle of the garbage can.

It is a further object of the present invention to provide a soft sided thermally insulated liner to be received in and secured to a 55 gallon drum receptacle.

It is another object of the present invention to provide a soft sided thermally insulated liner having relief cuts spaced such that overhanging flaps may be folded down without interfering with the operation or presence of the handles provided on a hard shell receptacle.

It is another object of the present invention to provide a means for securing a soft sided thermally insulated liner to a common hard shell receptacle comprising overlapping magnetic tabs.

It is another object of the present invention to provide a means for securing a soft sided thermally insulated liner to a common hard shell receptacle comprising overlapping Velcro strips.

It is yet another object of the present invention to provide a means for securing a soft sided thermal insulated liner to a common hard shell receptacle comprising a cinching cord and locking mechanism.

It is yet another object of the present invention to provide a thermally insulated soft sided liner having downwardly foldable flaps that are sufficiently pliable to be bunched and pushed down through a handle secured to a common hard shell receptacle.

It is yet another object of the present invention to provide a softshell thermally insulated liner having provisions for securing a top after the liner is installed and secured to a common hard shell receptacle.

It is a further object of the present invention to provide a collapsible cooler liner that is transportable that is customizable and may be printed with identifying indicia, logos and emblems.

SUMMARY OF THE INVENTION

The present invention is a collapsible cooler liner comprising pliable members erected and connected to approximate the inner dimensions of a common hard shell receptacle. Overhanging flaps extending from the upstanding pliable members are provided wherein the overhanging flaps are downwardly depending and further include means for securing the liner to the hard shell receptacle. The overhanging flaps extend downwardly to cover a substantial portion of the hard shell receptacle, thereby disguising the nature of the hard shell receptacle.

The means for securing the liner to the receptacle are incorporated into the downwardly depending flaps and comprise closure devices that are alternatively detachable and permanently connected closure devices. The downwardly depending flaps have relief cuts between them which are connected after the liner is placed into the hard shell receptacle to secure the liner to the receptacle. The closure devices effecting the securing of the liner to the receptacle comprise any of a number of alternatives, including a cinch cord and locking clasp, zipper, cooperating hook and loop fastening strips, button snaps, or spring loaded clamps, magnets and other devices that secure the downwardly depending flaps together after they are folded down. The closure device is alternatively a permanently connected closure device, such as a cinch cord and locking clasp, or a detachable closure device, such as cooperating hook and loop fastening strips, magnets or button snaps.

The collapsible liner of the present invention is provided with a watertight inner sleeve, an inner cylindrical portion to be contained within the hard shell receptacle which is free of any seams or stitch connections or perforations. The inner sleeve comprises the inside layer of a multiple layer open cylinder, there being also a corresponding middle insulating cylinder layer and an outer fabric layer. The inner sleeve, preferably formed from a molded sheet of durable material, is secured to the outer fabric layer at the top of the open end of the inner sleeve and the outer fabric layer. They are secured together using any of various methods, including without limitation stitching or welding or fusing them together. In the preferred embodiment wherein they are stitched, the seam is entirely outside the inner cylindrical portion to be contained within the hard shell receptacle such that the watertight nature of the inner cylindrical portion is not compromised.

The downward depending flaps are provided on various preferred embodiments of the present invention for different hard shell receptacles such that, when the flaps are folded down and connected, they do not interfere with the use of the handles of the receptacles. Relief cuts in the upper portion of the collapsible liner are sized and oriented to provide access and use of the handles of the receptacle while still substantially camouflaging and covering the remainder of the receptacle.

The collapsible liner of the present invention also includes accessory retention straps secured to an exterior side of the downwardly depending flaps. The collapsible cooler of the present invention also includes a lid secured around the top of the collapsible cooler.

The exterior side of the downwardly depending flaps is provided such that it can imprinted, embossed, engraved or embroidered to display logos, insignias, indicia and emblems. In a preferred embodiment of the present invention, the upper portion of the inner sleeve comprises the exterior side of the downwardly depending flap, and is constructed from a material onto which logos, insignias, indicia and emblems may be applied and displayed. It is also contemplated within the principles of the present invention that the downwardly depending flaps may be provided with hook and loop fasteners to receive panels with coordinated hook and loop fasteners, the panels having logos, insignias, indicia and emblems applied thereon.

DETAILED DESCRIPTION OF THE INVENTION

Figure 1:
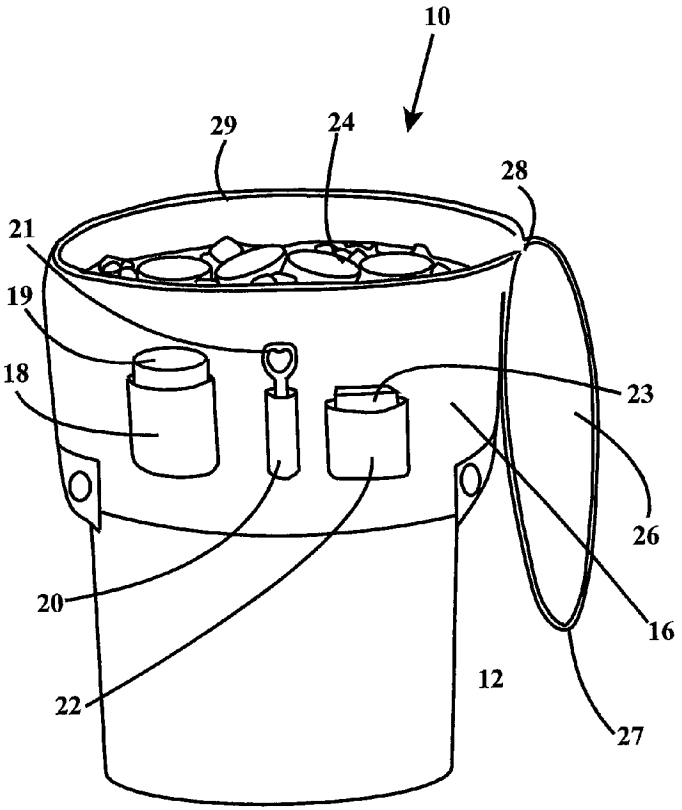
FIG. 1 is a perspective illustration of the insulated liner of the present invention retained in a hard shell five gallon bucket, illustrating the use of accessory pockets on the outer flaps and a permanently affixed closeable lid.

The present invention comprises a cooler 10 as shown in FIG. 1 having a soft sided inner liner 12 received in a hard shell outer container 14. In a first preferred embodiment, the liner 12 is positioned in a receptacle comprising a common five gallon bucket, but other receptacles are contemplated and the use thereof does not depart from the principles of the present invention. The liner 12 has downwardly depending flaps 16 and accessory pockets 18, 20, 22 secured thereto holding, for exemplary purposes, a drink 19, a bottle opener 21 and a deck of cards 23. Drinks are retained within the cooler 10 in an ice bath 24. In a preferred embodiment a lid 26 is secured to the liner 12 at a hinge point 28 whereby the lid 26 can be laid over and secured to the top of the inner liner 12 to prevent sunlight from hitting the ice bath 24. The lid 26 is secured to the liner 12 at closure means 27, 29 to accommodate transport of the cooler 10 from one location to another to minimize spillage of the contents. In a preferred embodiment the closure means 27, 29 comprise a first cooperating side of a zipper 29 on the liner 12, and a second cooperating side 27 on the lid 26. However, other cooperating closure devices 27, 29 such as, for example, Velcro, button snaps, magnets and other similar devices are contemplated by the principles of the present invention.

Figure 2:
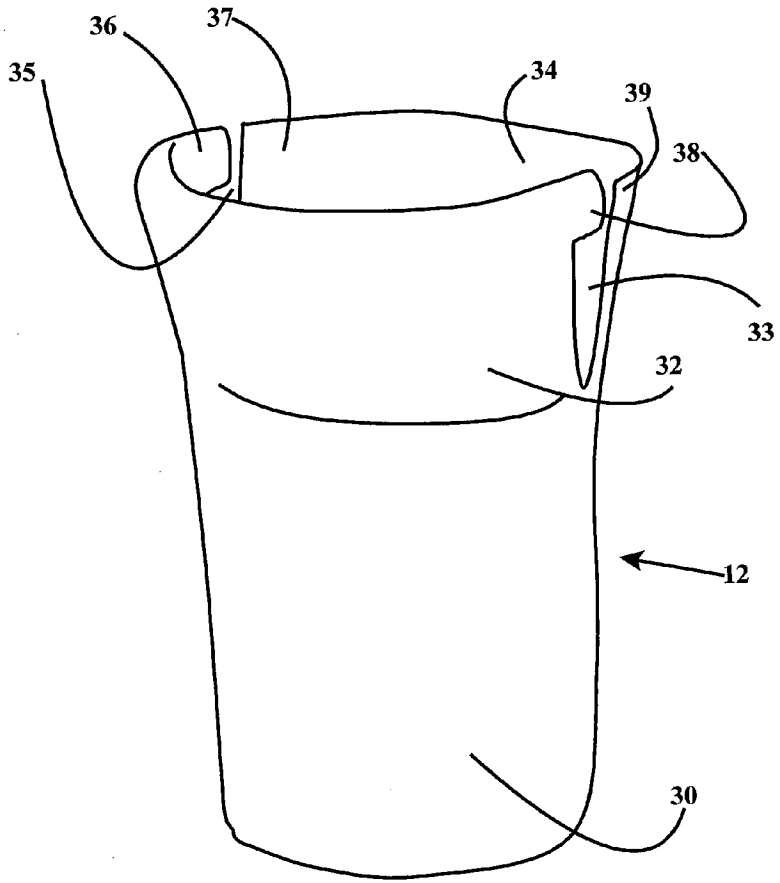
FIG. 2 is a perspective view of the soft sided thermally insulated liner of the present invention depicting relief cuts allowing flaps to be folded down to be free from interfering with a handle on a common five gallon bucket.

The inner liner 12 is shown isolated apart from the hard shell in FIG. 2, with an essentially cylindrical portion 30 approximately the height of the inner wall of a commonly available hard shell receptacle such as, without limitation, a typical five gallon bucket. Flaps 32, 34 shown upstanding in FIG. 2 prior to installation of the liner 12 in hard shell receptacle 14 are illustrated with relief cuts 33, 35. In a preferred embodiment, the flaps 32, 34 are provided with closure means 36, 38 comprising coordinating tabs 36, 37, 38, 39 that are used to secure the flaps 32, 34 to each other upon installation into the common hard shell receptacle 14 and folding down of the flaps 32, 34 such that they are downwardly depending as shown in FIG. 1. In a preferred embodiment, the tabs 36, 37, 38, 39 comprise detachable cooperating closure means such as for example hooks and loops fasteners, button snaps, a zipper, magnets and other cooperating devices that secure the tabs 36, 37, 38, 39 together and thereby secure the liner 12 within the hard shell receptacle 14. In a significant aspect of the present invention, the downwardly depending flaps 32, 34 when folded down, cover a substantial portion of the hard shell receptacle 14, as shown in FIG. 1. The principles of the present invention contemplate that the flaps 32, 34 of the liner 12 will cover approximately one-third (⅓) to one-half (½) of the hard shell receptacle 14. By providing such large downwardly depending flaps 32, 34 the nature of the receptacle 14 is disguised and camouflaged such that it is not apparent to the casual observer that common receptacles such as a five gallon buckets or garbage cans provide the structural support for the liner 12.

Figure 4:
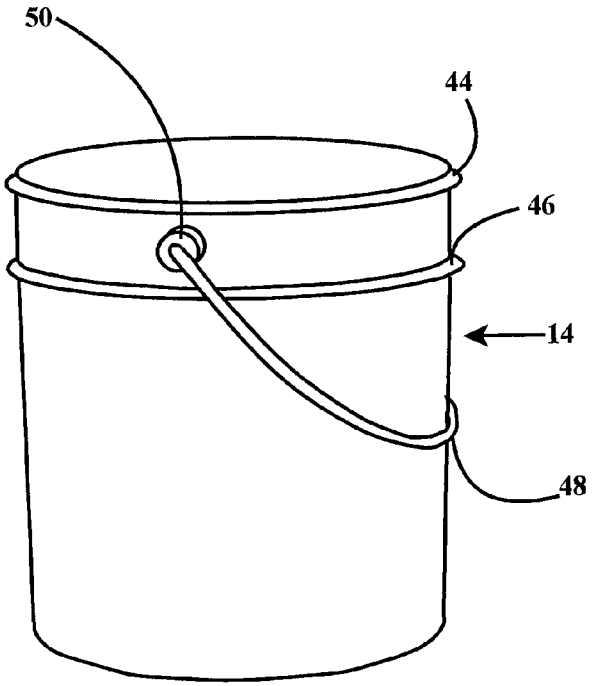
PRIOR ART Figure 4
FIG. 4 is a common five gallon bucket having a handle secured thereto which cooperates with the soft sided liner of the present invention.
Figure 3:
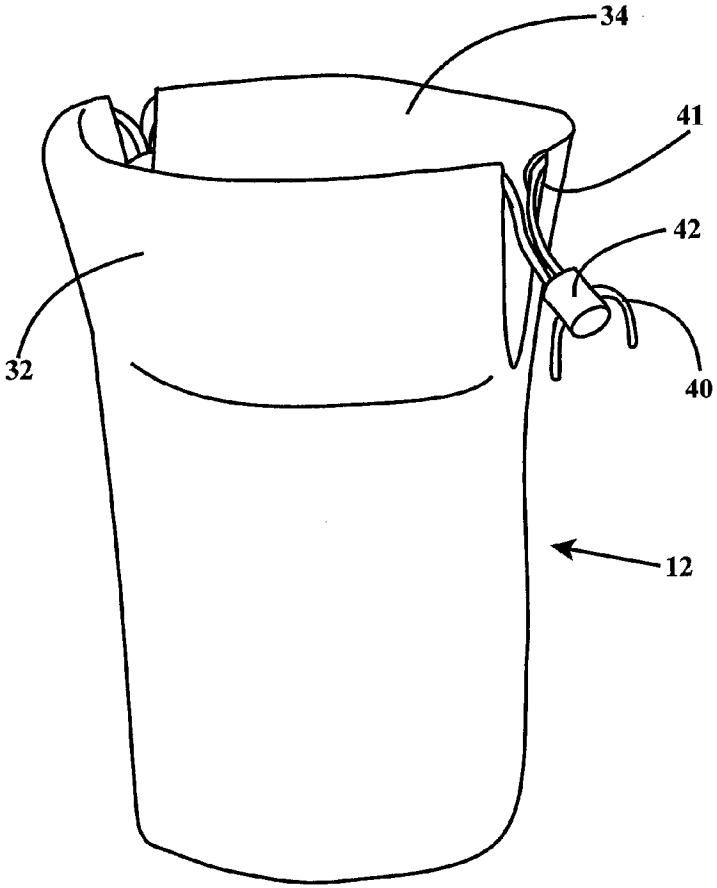
FIG. 3 is a perspective view of the soft sided thermally insulated liner of the present invention depicting a cinch cord used to secure the liner to a hard shell container.
Figure 6:
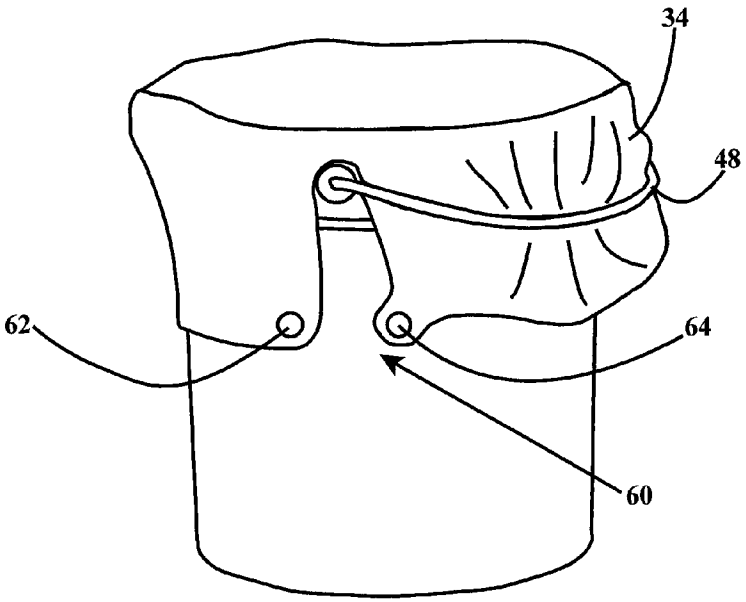
FIG. 6 is a perspective representation of the soft sided thermally insulated liner of the present invention wherein the flaps are being folded down over the upper lip of the bucket, with one flap bunched and being pushed through the handle secured to the bucket.
Figure 5:
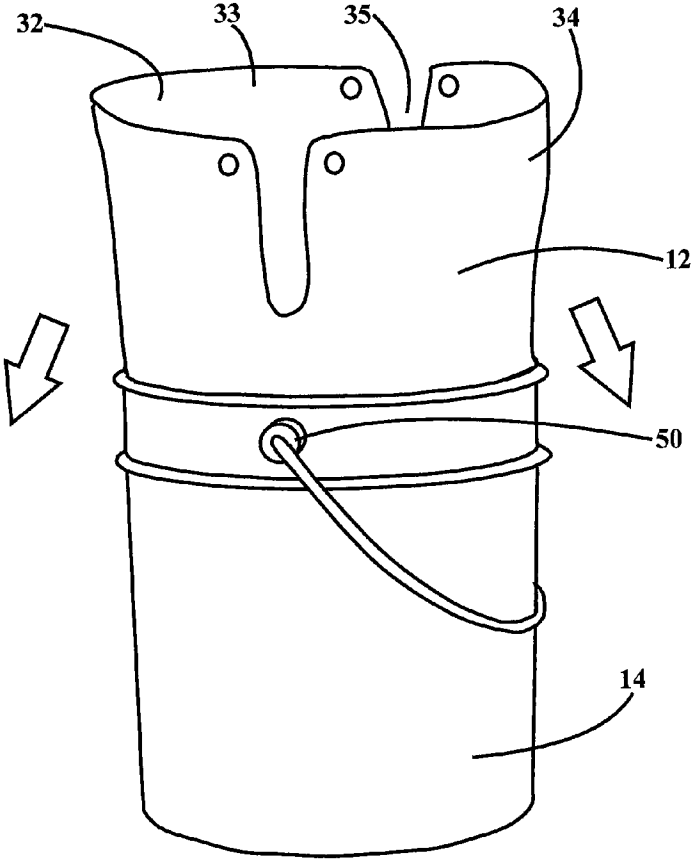
FIG. 5 is a perspective representation of the soft sided thermally insulated liner of the present invention received in a common five gallon bucket prior to the flaps being folded down over the upper lip of the bucket.

Alternatively, a preferred embodiment of the present invention is illustrated in FIG. 3 wherein liner 12 is provided with a permanently connected closure device comprising a cinch cord 40 threaded through sleeves 41 formed in the flaps 32, 34 and a locking device 42 on both sides. After installation of the liner 12, into the receptacle 14 and folding down of the flaps 32, 34 the cinch cord 40 is pulled taut to pull the flaps 32, 34 tightly around the exterior of the receptacle 14 to secure the liner 12 therein. In one specific application of the present invention, a typical five gallon bucket is provided as shown in FIG. 4 having an upper lip 44 and a lower ring 46 between which a handle 48 is pivotally connected at retention rings 50, 52. To install a liner 12 in the bucket 14, as shown in FIG. 5, the liner 12 is pushed down into the bucket 14 until the bottom of the liner 12 reaches the bottom of the bucket 14. The liner 12 is a preferred embodiment of the present invention having detachable cooperating means depicted by snap buttons 62, 64. In the application depicted in FIG. 5, when the flaps 32, 34 extend downwardly on a receptacle 14 having a handle 48 it is necessary to provide such separable, detachable closure means 62, 64. The liner 12 is installed such that the relief cuts 33, 35 are immediately above the handle retention disks 50, 52. The flaps 32, 34 are folded down as shown in FIG. 6, with one flap 30 being bunched and pushed down through the handle 48. After being folded down, the flaps 32, 34 extend below the lower ring 46 of the five gallon bucket, such that when a closure mechanism 60 on the flaps 32, 34, in this case comprising coordinated snap buttons 62, 64, is connected, the liner 12 will be secured in the bucket 14, with the lowest point of the flaps 32, 34 secured below the lower ring 46 of the bucket 14. When the flaps 32, 34 are folded down and connected at the tabs by coordinated snap buttons 62, 64, a substantial portion of the bucket 14 is hidden and camouflaged by the liner 12 to be placed in the bucket 14 and the flaps 32, 34 folded down through the handle 48 and connected to secure the liner 12 in the bucket 14. An alternative embodiment of the present invention, depicted in FIG. 3 with a permanently connected closure device such as the cinch cord 40 and locking mechanism 42 could be used with a bucket without a handle 48 that does not require bifurcation or separation of the fold down flaps 32, 34.

Figure 7:
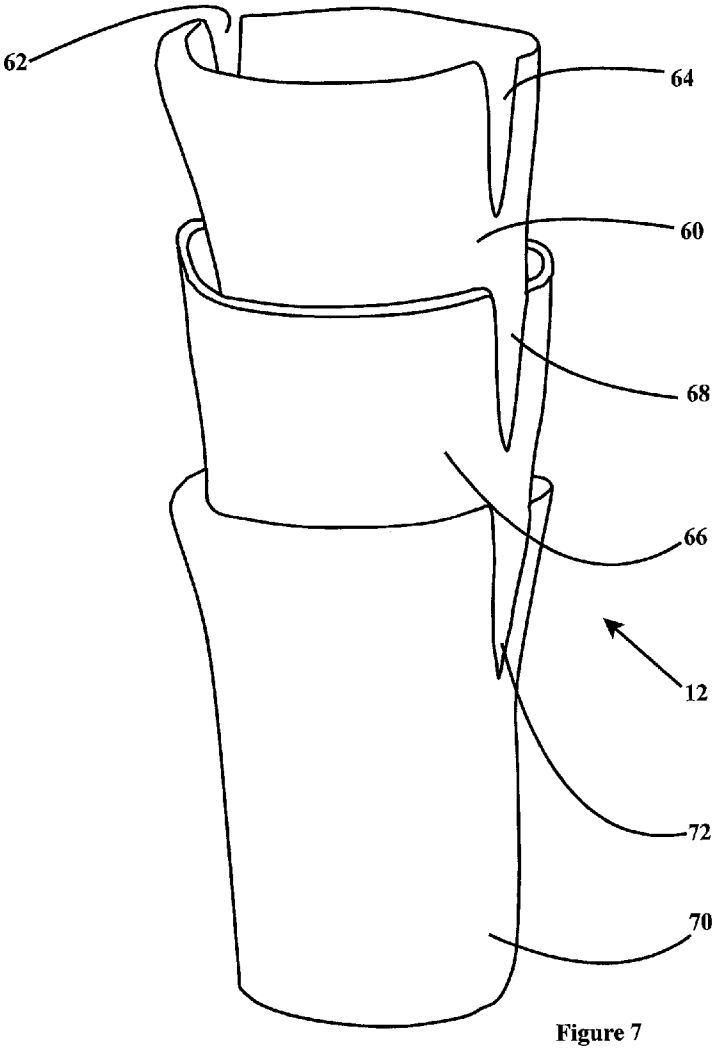
FIG. 7 is a representation of the three layers of the thermally insulated soft sided liner of the present invention showing an inner waterproof liner, an intermediate insulating layer, and an outer soft sided shell.

As shown in FIG. 7, the liner 12 preferably comprises three layers of material. The innermost layer comprises a molded sleeve 60 of mylar having relief cuts 62, 64 therein, the sleeve 60 being an open top cylinder formed in a mold. The mylar sleeve 60 is watertight and is molded so that there is no stitching that will be below the level of the hard shell receptacle that would create an opportunity for water to leak therethrough. The mylar sleeve 60 is received in a similarly shaped insulating foam cylinder 66, the foam cylinder 66 having relief cuts 68, 69 corresponding to the relief cuts 62, 64 in the inner mylar sleeve 60. In the most preferred embodiment of the present invention, the foam cylinder 66 comprises multiple panels of open cell foam insulation material sewn together in the shape of the cylinder 66. The combination of the mylar cylinder 60 and foam cylinder 66 is then received in an outer fabric sleeve 70 having relief cuts 72, 74 that correspond with and align with the relief cuts 62,64 in the mylar sleeve and relief cuts 68, 69 in the insulated foam cylinder 66.

In a significant aspect of the present invention, the mylar sleeve 60, the insulating foam sleeve 66, and the outer fabric sleeve 70 are sewn together along the top and the relief cuts only. There is no stitching, opening or compromise of the solid watertight sleeve 60 below where the liner 12 will engage the top lip of a hard shell receptacle to prevent any leakage of water out through the stitch holes. Maintaining the watertight nature of the sleeve 60 and preventing water from seeping into the foam cylinder 66 is accomplished by forming the inner sleeve 60 as a molded cylinder and not compromising its integrity with stitching or seams.

Figure 9:
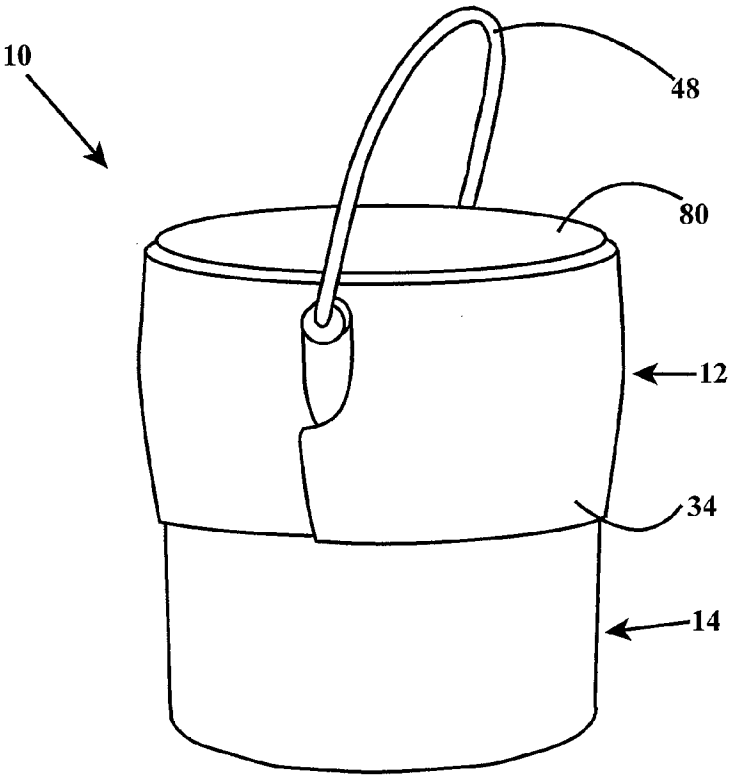
FIG. 9 of the present invention illustrates the thermally insulated soft sided liner of the present invention mention secured to a 5 gallon bucket with a lid secured thereto and an operable handle to carry the cooler.
Figure 8:
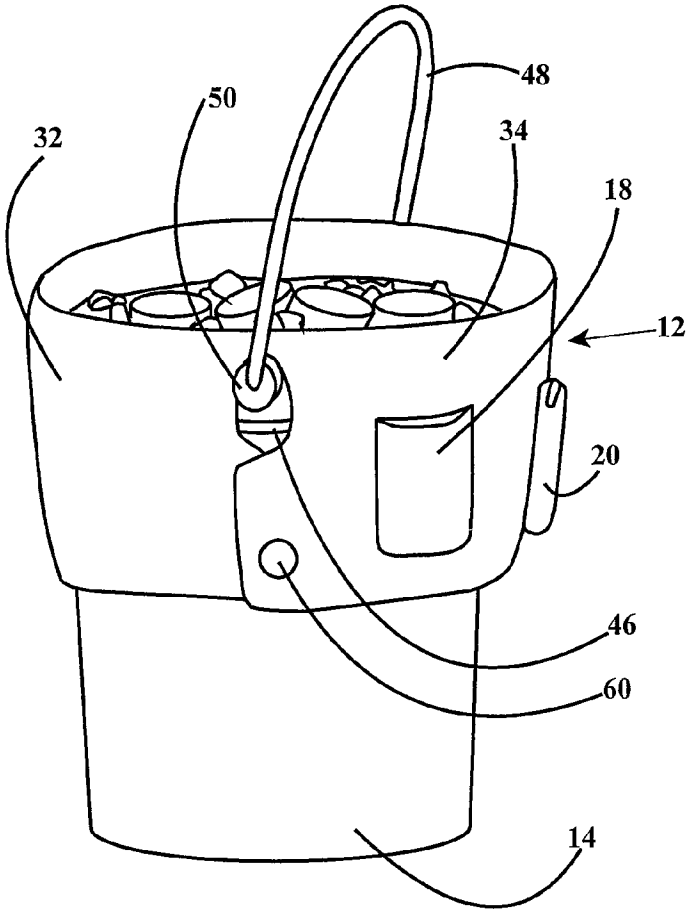
FIG. 8 is a pictorial depiction of the thermally insulated soft sided liner of the present invention received in a five gallon bucket with the flaps folded down and secured that does not interfere with the handle of the bucket.

The beneficial use of the liner 12 is depicted in FIGS. 8 and 9 wherein flaps 32, 34 are secured together by a closure mechanism 60 such that it is connected tightly below the lower ring 46 of the bucket and covers a substantial portion of the bucket 14, thereby obscuring and camouflaging the nature of the bucket 14. In this way, the liner 12 is securely retained in the bucket 14. Furthermore, when the flaps 32, 34 are folded down, the relief cuts 33, 35 allow the handle 48 to continue to operate because they do not interfere with the pivot receptacles 50, 52. Accessory pockets 18, 20 are shown in FIG. 8 secured to the downwardly defending flap 34. In FIG. 9, the cooler 10 of the present invention is depicted with the downwardly depending flaps 32, 34 secured allowing access to the handle 48 while a lid 80 is positioned on top of the inner liner 12, so that a user can put the lid 80 on the cooler and still carry it at the handle 48. It is contemplated that the lid 80 may be secured to the liner 12 in a variety of ways, as shown in FIG. 1 by closure means 27, 29 comprising any of a zipper, hooks and loops fastening strips, button snaps, magnets and other cooperating devices.

Figure 10:
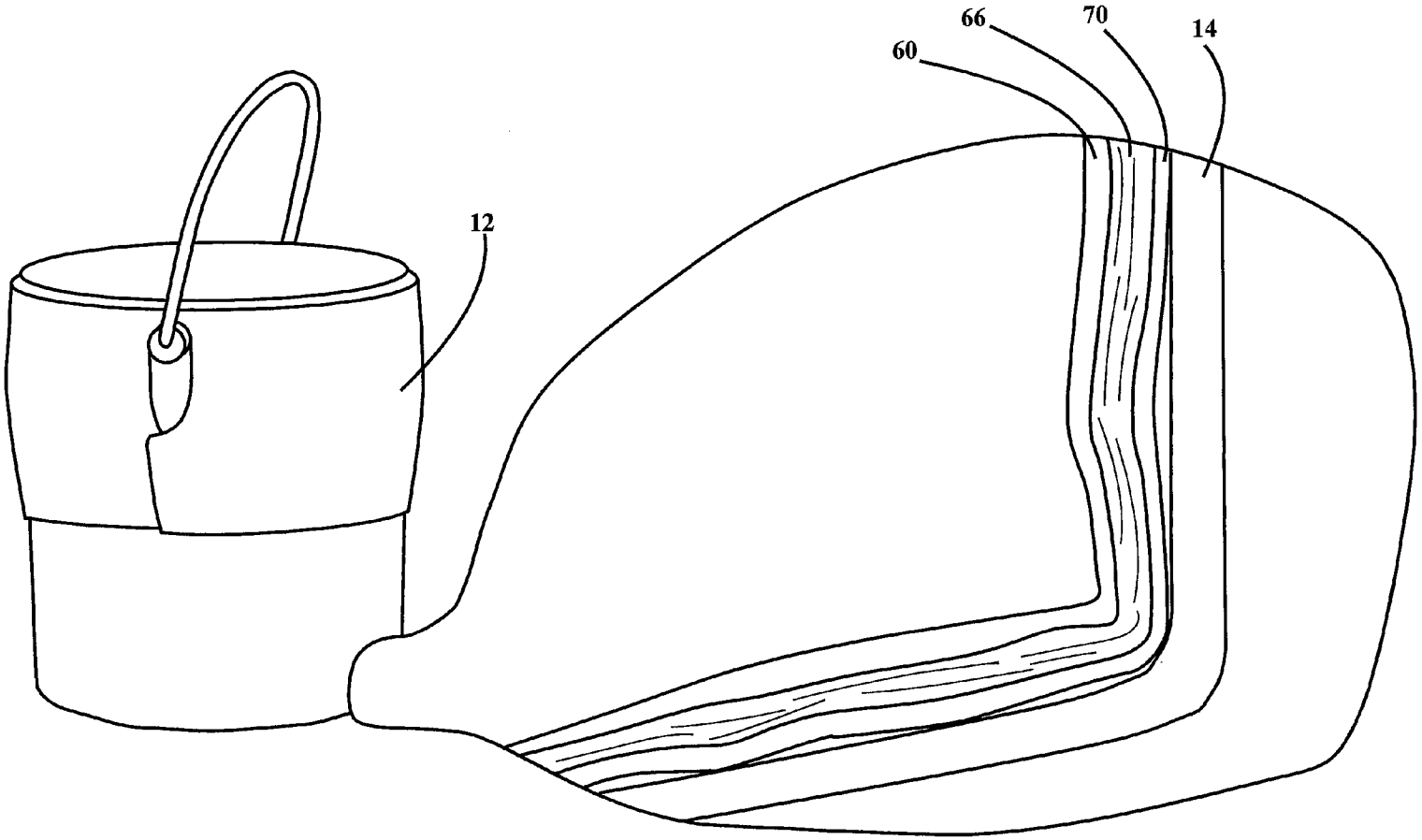
FIG. 10 is a blown up portion of the soft sided thermally insulated liner of the present invention depicting the three layers of the liner retained in the hard shell receptacle.

FIG. 10 illustrates the three layer construction of the inner liner 12 in a blown up cross section view of the liner 12 in the bucket 14. Specifically, an interior layer 60 of mylar is provided that is watertight so that, if the ice melts in the liner, it does not leak through to the foam insulation layer 66. In the most preferred embodiment of the present invention, the insulating layer 66 comprises sheets of open cell foam that provide a layer of insulation between the inner mylar layer 60 and the outer plastic shell 70. Water is prevented from seeping through the inner sleeve 60 to the foam insulation layer 66 by forming a molded sleeve 60 and maintaining its watertight integrity by not stitching or sewing or otherwise perforating or puncturing it.

Figure 11:
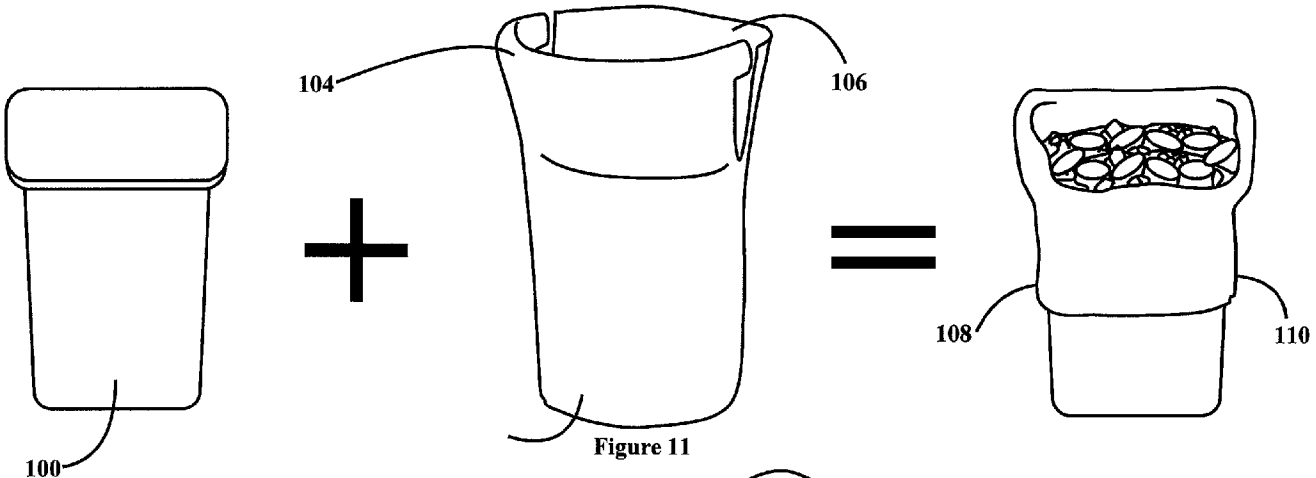
FIG. 11 is a depiction of a thermally insulated soft sided liner retained in a common tall kitchen garbage can.

FIG. 11 depicts the use of a thermally insulated inner liner 102 sized to fit into a common receptacle, a tall kitchen garbage can 100. The kitchen garbage can liner 102 is received in the garbage can 100, and its flaps 104, 106 are folded down and secured to one another at points 108, 110. Similar to the five gallon bucket insulated liner, the kitchen garbage can liner 102 has flaps 104, 106 that extend a substantial length down the sides of receptacle 100 to disguise and camouflage the nature of the receptacle 100.

Figure 12:
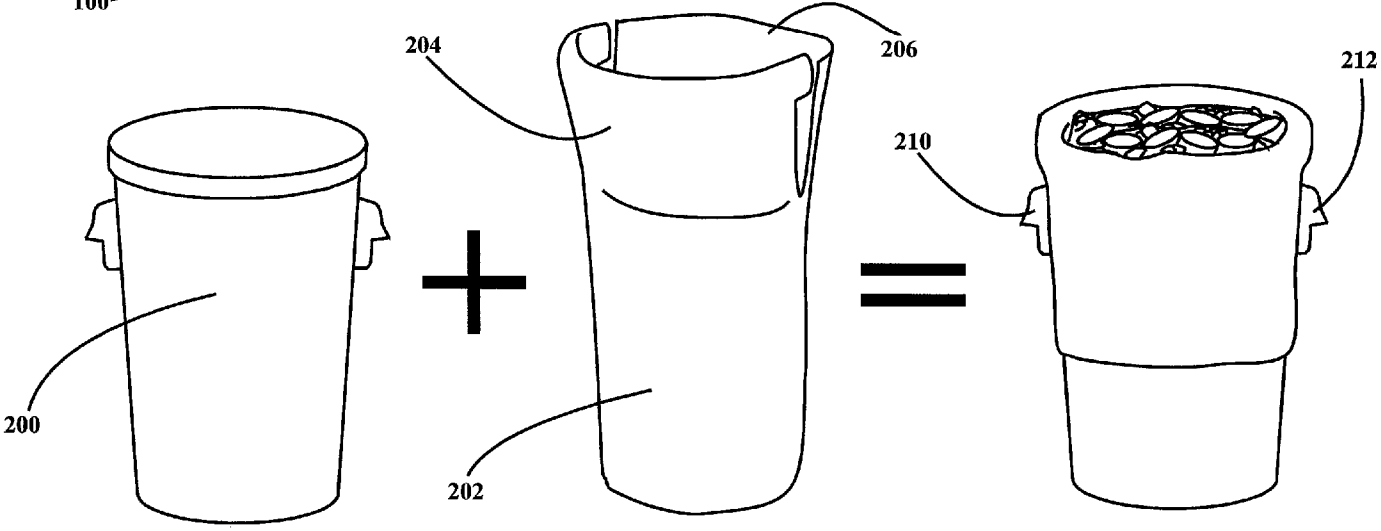
FIG. 12 is a depiction of a thermally insulated soft sided liner retained in a large garbage can with opposed handles in such a way that the downwardly depending flaps do not interfere with the use of the garbage can handles.
Figure 14:
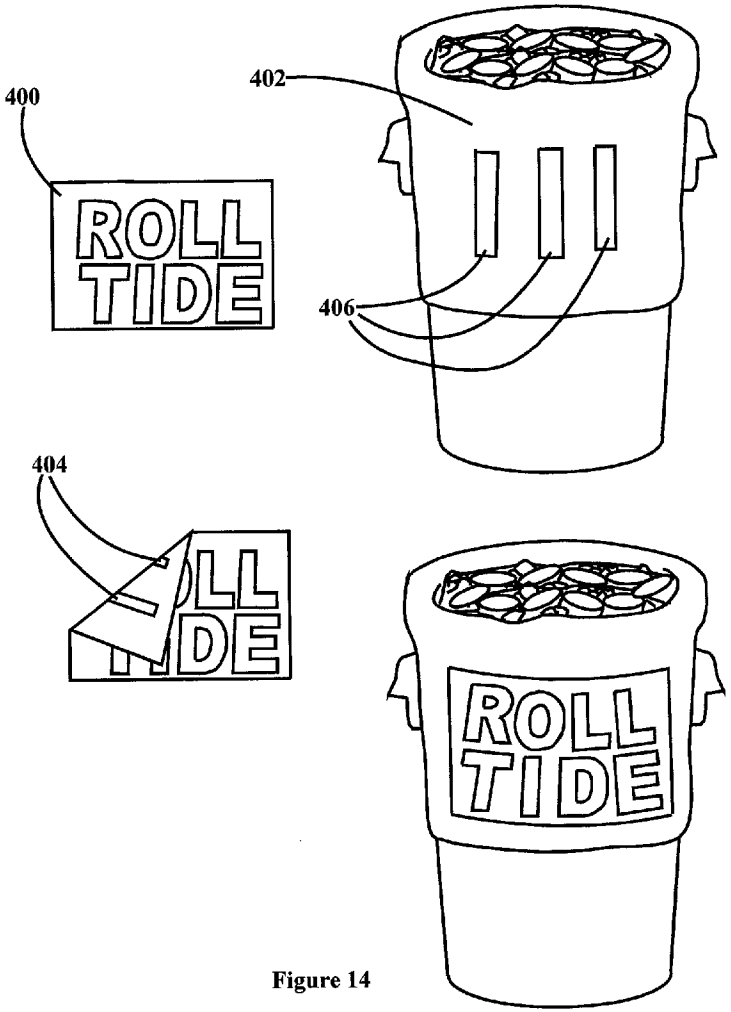
FIG. 14 is a multi figure illustrating the use of multiple panels having logos emblems or indicia removably affixed and secured to the downwardly depending flaps.

FIG. 12 is a depiction of the use of a thermally insulated inner liner sized to fit into a large garbage can 200, the garbage can liner 202 being sized to fit in the garbage can 200, while still having relief cuts 204, 206 that allow the inner liner to be engaged in the garbage can without interfering with access to the handles on the garbage can. Similar to the five gallon bucket insulated liner, the large garbage can liner 202 has flaps 204, 206 that extend a substantial length down the sides of receptacle 200 to disguise and camouflage the nature of the receptacle 200.

Figure 13:
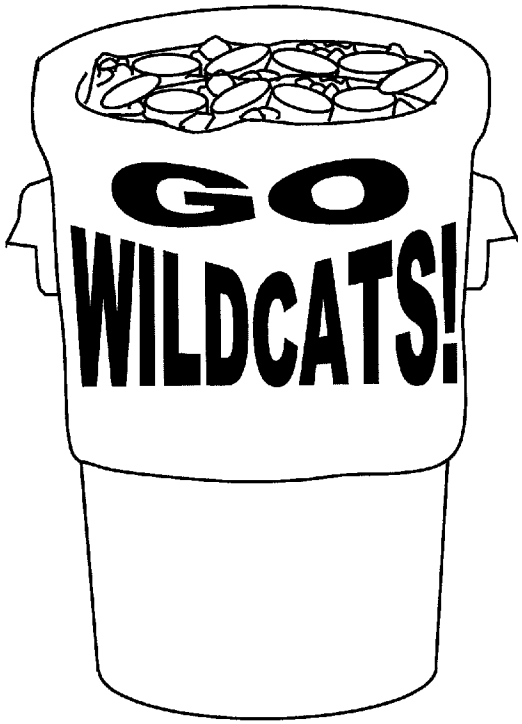
FIG. 13 is a depiction of a thermally insulated soft sided liner having downwardly depending flaps with a logo displayed on the exterior of the flaps.

In each of the preferred embodiments, as illustrated generally at FIG. 13, the exterior side of the downwardly depending flaps 32, 34, 104, 106, 204, 206 is provided such that they can imprinted, embossed, engraved or embroidered to display logos, insignias, indicia and emblems. In a preferred embodiment of the present invention, the upper portion of the inner sleeve comprises the exterior side of the downwardly depending flap when the liner 12, 102, 202 is secured in a receptacle, and is constructed from a material onto which logos, insignias, indicia and emblems may be applied and displayed. It is also contemplated within the principles of the present invention that the downwardly depending flaps may be provided with hook and loop fasteners to receive panels with coordinated hook and loop fasteners, the panels having logos, insignias, indicia and emblems applied thereon.

The collapsible liners 12, 102, 202 disclosed herein provide a highly portable cooler that takes advantage of being used in conjunction with commonly available hard shell receptacles such as, for example and without limitation, a five gallon bucket, a tall kitchen garbage can and a large garbage can. The liners 12, 102, 202 are constructed from layers of pliable materials and may be collapsed for transport and then erected at the point of use and secured to the common receptacle available. The liners 12, 102, 202 add to the festivities of the occasion by allowing users to display logos, insignias, emblems or other indicia on the sizable downwardly depending flaps 32, 34, 104, 106, 204, 206 that are provided in alternative embodiments as a printable surface on the outwardly facing exterior panel when the liner is erected in a receptacle, or by providing means for securing a panel or placard having a logo or team represented thereon to the flaps 32, 34, 104, 106, 204, 206. For example, and without limitation, an appropriately sized panel 400 is removably secured to a flap 402 using a means for securing thereto. In a preferred embodiment of the present invention, the panel 400 is secured through the use of hook connector strips 404 affixed to the panel 400 and loop connector strips 406 affixed to the panel 402. Other devices for removably securing the panel 400 to the flap 402 are contemplated, including without limitation button snaps, zippers, magnets and other devices providing for temporary adhesion between the panel 402 and flap 400.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

I claim:

1. A collapsible cooler comprising:

a watertight liner comprising an open top cylinder formed from pliable members and connected to approximate the inner dimensions of a common hard shell receptacle;

overhanging straps extending from said line, wherein said overhanging flaps are downwardly depending and further comprise means for securing said liner to said hard shell receptacle when a bottom of the liner reaches a bottom of said hard shell receptacle;

wherein said watertight liner comprises three layers of material, each comprising open top cylinders having relief cuts therein, an innermost layer comprises an inner molded cylinder, a foam cylinder comprises foam insulation material, and a combination of said inner cylinder and said foam cylinder are received in an outer fabric sleeve, wherein all three layers have corresponding aligned relief cuts.

2. The collapsible container as set forth in claim 1 further comprising accessory retention straps secured to an exterior side of the downwardly depending flaps.

3. The collapsible container as set forth in claim 2 further comprising a lid secured around the top of said collapsible cooler.

4. The collapsible container as set forth in claim 1 wherein said watertight liner disguises said hard shell receptacle, said overhanging flaps extending to cover a substantial portion of said hard shell receptacle.

5. The collapsible container as set forth in claim 1 wherein said means for securing comprises detachable cooperating closure means.

6. The collapsible container as set forth in claim 1 wherein said means for securing comprises a permanently connected closure device.

7. The collapsible container as set forth in claim 1 wherein said watertight liner comprises an open top cylinder formed in a mold.

8. The collapsible container as set forth in claim 7 wherein said watertight liner further comprises an insulating middle layer comprising a foam cylinder and a fabric outer sleeve.

9. The collapsible container as set forth in claim 8 wherein said molded inner sleeve is secured to said fabric outer sleeve along a top and relief cuts only.

10. The collapsible container as set forth in claim 1 wherein said means for securing comprises provisions allowing use of handles on said receptacle.

11. The collapsible container as set forth in claim 1 wherein said overhanging flaps comprise means for displaying indicia.

12. The collapsible container set forth in claim 1 Marian said three layers are sewn together along a top and said relief cuts only, whereby the watertight nature of said inner molded cylinder within the receptacle is maintained and not compromised with stitching or seams.

* * * * *